US009482420B2

(12) United States Patent
Chien et al.

(10) Patent No.: US 9,482,420 B2
(45) Date of Patent: Nov. 1, 2016

(54) LED EXPLOSION-PROOF LAMP COUPLING STRUCTURE

(71) Applicant: Li-Hong Science & Technology Co., Ltd., Kaohsiung (TW)

(72) Inventors: Ming-Tien Chien, Kaohsiung (TW); Ching-Yuan Juan, Kaohsiung (TW); Han-Wen Chang, Kaohsiung (TW); Cheng-Lung Juan, Kaohsiung (TW)

(73) Assignee: LI-HONG SCIENCE & TECHNOLOGY CO., LTD., Kaohsiung (TW)

( * ) Notice: Subject to any disclaimer, the term of this patent is extended or adjusted under 35 U.S.C. 154(b) by 218 days.

(21) Appl. No.: 14/512,202

(22) Filed: Oct. 10, 2014

(65) Prior Publication Data

US 2016/0010839 A1 Jan. 14, 2016

(30) Foreign Application Priority Data

Jul. 8, 2014 (TW) ..... 103123500 A

(51) Int. Cl.

| | |
|---|---|
| ***F21V 25/12*** | (2006.01) |
| ***F21K 99/00*** | (2016.01) |
| ***F21V 21/002*** | (2006.01) |
| ***F21V 21/005*** | (2006.01) |
| ***F21V 31/00*** | (2006.01) |
| ***F21S 8/00*** | (2006.01) |
| *F21Y 101/02* | (2006.01) |

(52) U.S. Cl.

CPC ..... *F21V 25/12* (2013.01); *F21K 9/30* (2013.01); *F21S 8/03* (2013.01); *F21V 21/002* (2013.01); *F21V 21/005* (2013.01); *F21V 31/005* (2013.01); *F21Y 2101/02* (2013.01)

(58) Field of Classification Search

CPC .... F21V 25/12; F21V 21/005; F21V 31/005; F21V 21/002; F21S 8/03; F21K 9/30; F21Y 2101/02

See application file for complete search history.

(56) References Cited

U.S. PATENT DOCUMENTS

| | | | | | |
|---|---|---|---|---|---|
| 2,529,706 | A * | 11/1950 | Pearson | F21V 25/12 | 340/815.49 |
| 5,158,359 | A * | 10/1992 | Penturelli | F21V 25/12 | 362/221 |
| 2003/0012027 | A1* | 1/2003 | Hsu | F21S 8/065 | 362/404 |
| 2011/0242828 | A1* | 10/2011 | Blincoe | F21V 29/004 | 362/373 |
| 2013/0314921 | A1* | 11/2013 | Chen | F21V 29/20 | 362/249.02 |
| 2015/0285480 | A1* | 10/2015 | Chien | F21V 25/12 | 362/311.02 |
| 2015/0308672 | A1* | 10/2015 | Chien | F21V 25/12 | 362/457 |

* cited by examiner

*Primary Examiner* — Britt D Hanley

(74) *Attorney, Agent, or Firm* — Muncy, Geissler, Olds & Lowe, P.C.

(57) ABSTRACT

A LED explosion-proof lamp coupling structure to couple at least two LED explosion-proof lamps includes at least two holding sets, at least two LED lighting elements, and at least one connection unit. Each holding set includes a body, a protruding connection portion located on an upper end of the body, a chamber located in the body, and at least one first coupling portion located at one end of the body and communicating with the chamber. Each first coupling portion includes a hole communicating with the chamber and a positioning seat located on chamber and abutting the hole. Each LED lighting element is connected to the protruding connection portion. The connection unit includes a connection tube connected to each first coupling portion and at least one first fastening set to fasten the connection tube to the positioning seat. Thus the holding sets can be coupled with each other.

20 Claims, 11 Drawing Sheets

LED EXPLOSION-PROOF LAMP COUPLING STRUCTURE

FIELD OF THE INVENTION

The present invention relates to a LED explosion-proof lamp coupling structure and particularly to a LED explosion-proof lamp coupling structure for connecting at least two LED explosion-proof lamps.

BACKGROUND OF THE INVENTION

Industrial sites such as chemical, petrochemical, oilfields, coalmines and the like often are scattered or stocked with gases, dust or chemicals that are inflammable, easily exploded or oxidized, or corrosive. Hence lamps used on those sites must be explosion-proof to avoid explosion incident caused by sparks that might be generated by worn out or faulty general non explosion-proof lamps.

In those potentially explosive environments the explosion-proof lamp often provides a limited projection range, as a result there are always some blind spots falling outside of the projection range of the explosion-proof lamp. Hence many more explosion-proof lamps must be installed, or multiple sets of explosion-proof lamps have to be connected in series to overcome the problem of non-illuminating blind spots. The conventional approach of connecting the explosion-proof lamps is done via a connection set. More connection sets are required when more explosion-proof lamps are to be connected together. This makes the cost higher and consumer's purchasing desire lower.

To solve the problem of relying on extra connection sets for serial connection of explosion-proof lamps that occurs to the conventional practice, another technique has been proposed as shown in FIG. 1, in which two sets of explosion-proof lamps A1 that are to be coupled together can be accomplished by providing a connection dock A2 on each explosion-proof lamp A1, and fastening the two connection docks A2 together through a plurality of screws B1. However, the screws B1 are exposed outside the connection docks A2, it is not appealing in appearance and makes consumers reluctant to buy. There are still rooms for improvement.

SUMMARY OF THE INVENTION

The primary object of the present invention is to provide a LED explosion-proof lamp coupling structure to connect at least two sets of LED explosion-proof lamps.

To achieve the foregoing object the LED explosion-proof lamp coupling structure of the invention includes at least two holding sets, at least two LED lighting elements, and at least one connection unit. Each holding set includes a body, a protruding connection portion located on an upper end of the body, a chamber located in the body and the protruding connection portion, and at least one first coupling portion located at one end of the body and communicating with the chamber horizontally. Each first coupling portion includes a hole communicating with the chamber, at least one pair of pin holes abutting the hole and remote from the chamber, a first annular groove abutting the pin holes and remote from the hole, and a positioning seat located on the chamber and abutting the hole. Each LED lighting element is connected to the protruding connection portion of each holding set. The connection unit includes a connection tube connected to each first coupling portion and run through the hole, a sealing ring located in the first annular groove, at least one pair of anchor members inserted in each pair of pin holes, and at least one first fastening set to fasten the connection tube to each positioning seat. The connection tube includes two protruding wedge portions located at two ends thereof, at least one second annular groove abutting each protruding wedge portion and a passage located inside the connection tube.

The invention thus formed provides features as follows:

1. The holding sets can be connected with each other through the first coupling portion of the body via the connection unit, thereby a plurality of LED explosion-proof lamps can be coupled together.
2. The connection unit is located in the hole of each first coupling portion, hence can overcome the problem of unappealing appearance occurred to the conventional techniques.
3. By mating one pair of the pin holes on each first coupling portion and one pair of the anchor members, one holding set can be coupled with another holding set at a different angle.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
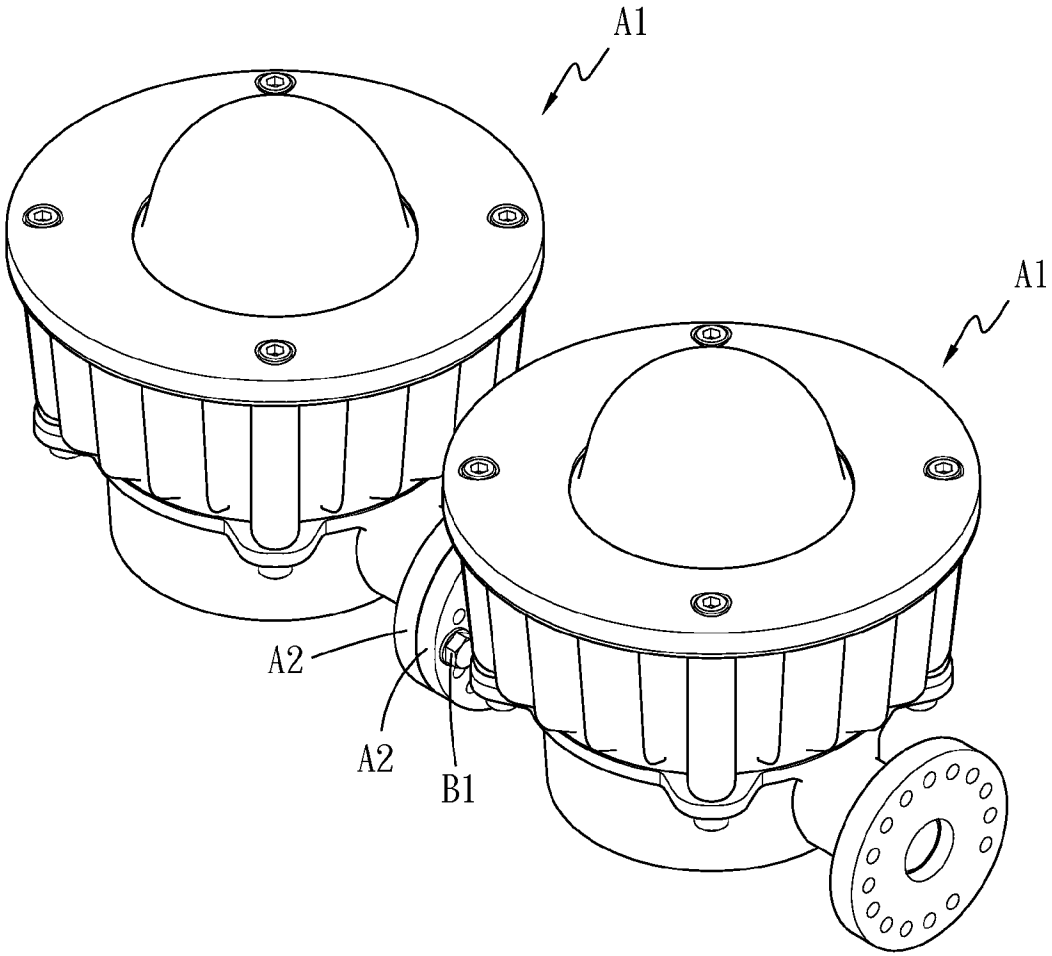
Fig. 1 PRIOR ART
FIG. 1 is a perspective view of conventional explosion-proof lamps in a serial connecting condition.
Figure 2:
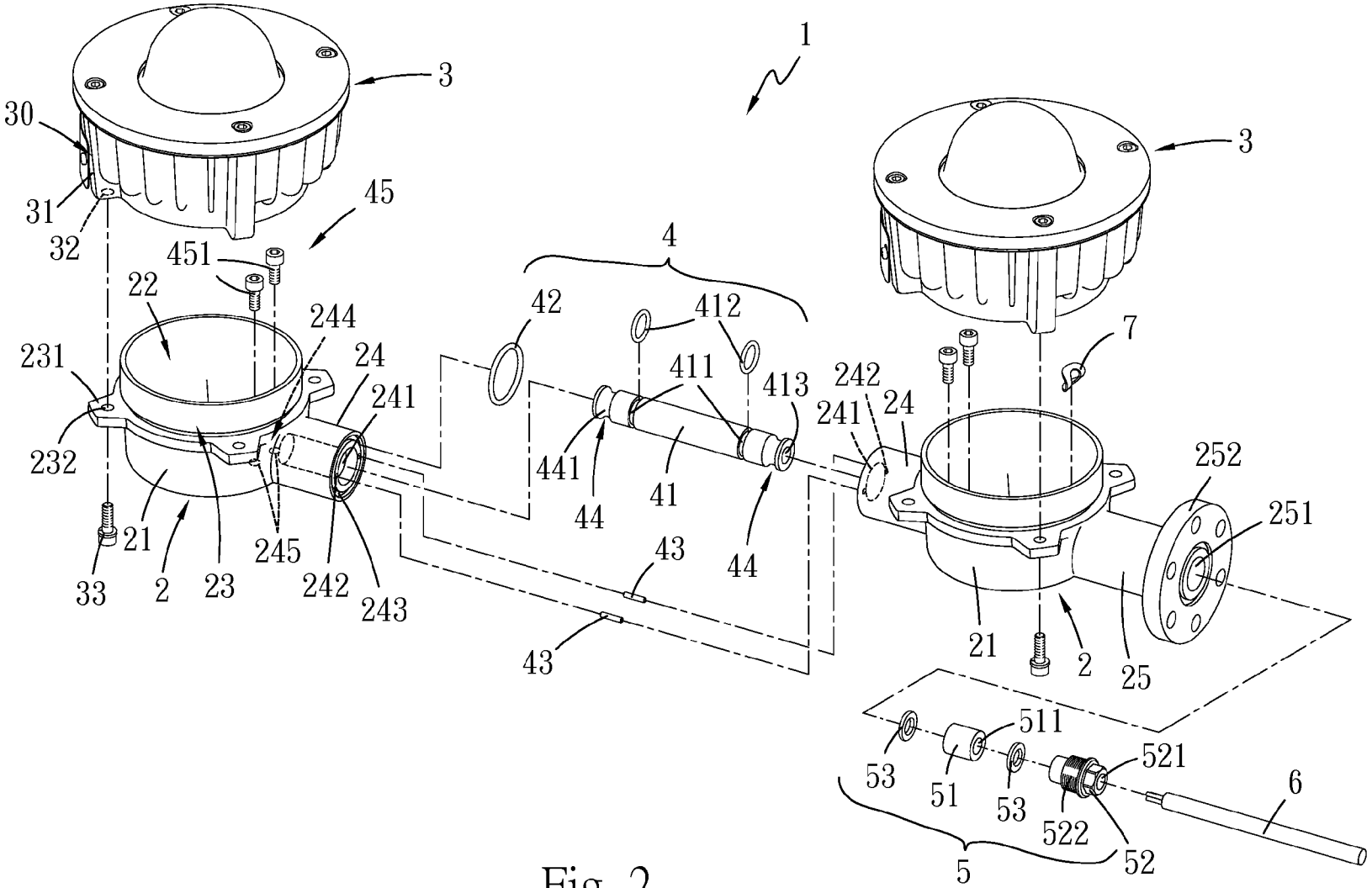
FIG. 2 is an exploded view of a first embodiment of the invention.
Figure 5:
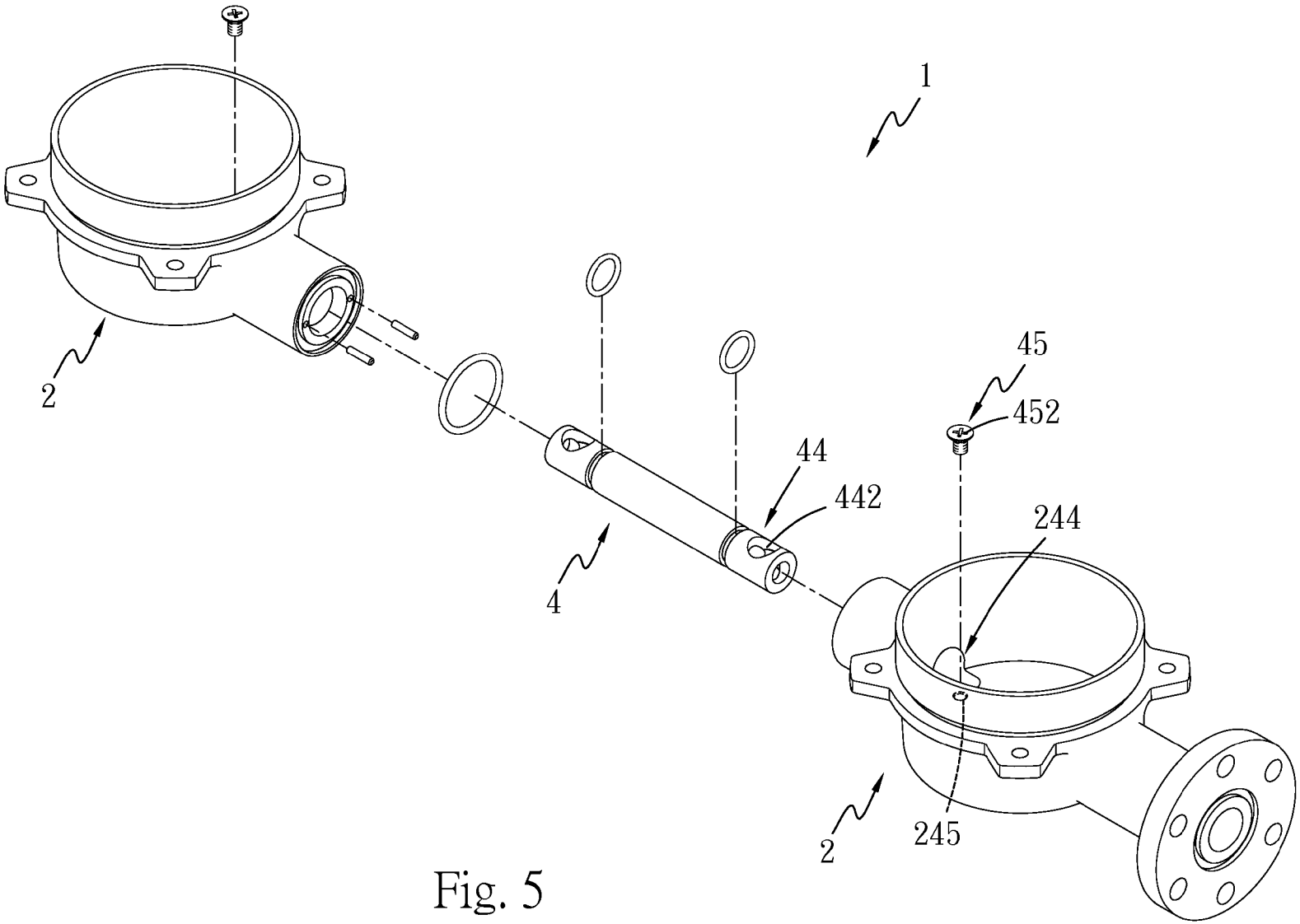
FIG. 5 is an exploded view of a third embodiment of the invention.
Figure 6:
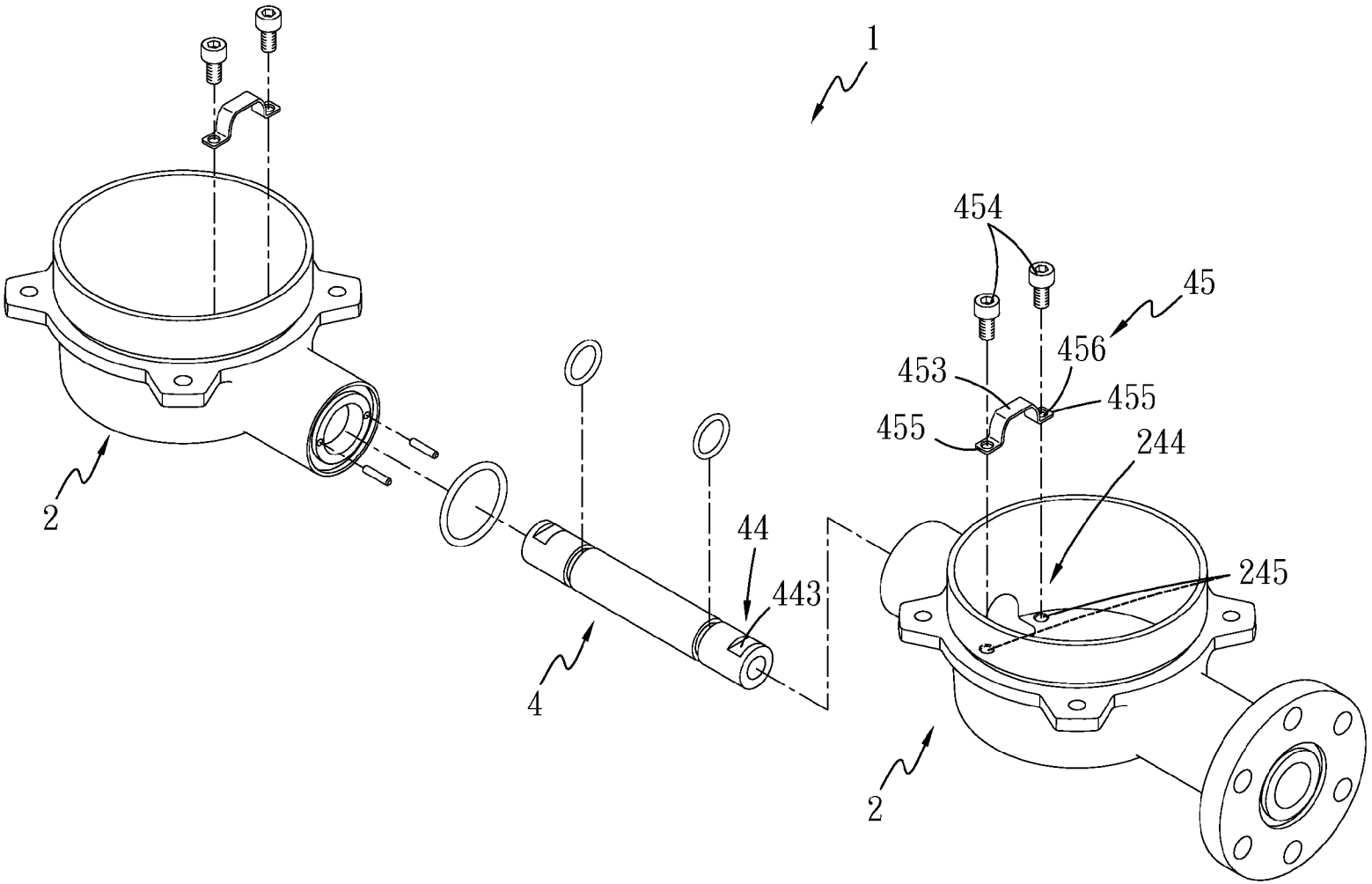
FIG. 6 is an exploded view of a fourth embodiment of the invention.

The present invention aims to provide a LED explosion-proof lamp coupling structure 1 to couple at least two LED explosion-proof lamps together, as shown in FIGS. 2, 5 and 6. Please refer to FIGS. 2 through 3B for a first embodiment of the LED explosion-proof lamp coupling structure 1 of the invention. It includes at least two holding sets 2, at least two LED lighting elements 3 and at least one connection unit 4. In this embodiment the holding sets 2 and the LED lighting elements 3 include respectively two units, while the connection unit 4 is one set, but this is not the limitation of the invention. Each holding set 2 includes a body 21, a protruding connection portion 23 located on an upper section of the body 21, a chamber 22 formed in the body 21 and the protruding connection portion 23, and at least one first coupling portion 24 located at one end of the body 21 and communicating with the chamber 22 horizontally. The protruding connection portion 23 includes a plurality of flanges 231 extended outwards and a first fastening hole 232 on each flange 231. Each first coupling portion 24 includes a hole 241 communicating with the chamber 22, at least one pair of pin holes 242 abutting the hole 241 and remote from the chamber 22, a first annular groove 243 formed annularly adjacent to the pin holes 242 and remote from the hole 241, and a positioning seat 244 located on the chamber 22 and abutting the hole 241. The positioning seat 244 includes at least one second fastening hole 245. In the first embodiment two second fastening holes 245 are provided on each positioning seat 244, but this is not the limitation of the invention. In this embodiment the pin holes 242 on each first coupling portion 24 is, but not limited to, one pair. Each LED lighting element 3 includes a wedge portion 30 on the perimeter thereof connected to the protruding connection portion 23. The wedge portion 30 includes a plurality of protruding plates 31 on the perimeter of the LED lighting element 3 facing the protruding connection portion 23, a third fastening hole 32 located at a lower end of each protruding plate 31 facing each first fastening hole 232, and a plurality of fasteners 33 each runs through each first fastening hole 232 and fastens to each third fastening hole 32 so that the wedge portion 30 can be fastened to the protruding connection portion 23. The connection unit 4 includes a connection tube 41 connected to each first coupling portion 24 and run through the hole 241, a sealing ring 42 located on each first annular groove 243, at least one pair of anchor members 43 inserted in each pair of pin holes 242, at least one first fastening set 45 to fasten the connection tube 41 to each positioning seat 244, and at least one washer 412 located on the connection tube 41. In this embodiment the anchor members 43 are, but not limited to, one pair of pins. The connection tube 41 also includes two protruding wedge portions 44 located at two ends thereof and run through respectively each hole 241 and connected to the positioning seat 244, at least one second annular groove 411 abutting each protruding wedge portion 44 to hold the washer 412, and a passage 413 inside the connection tube 41. In this embodiment the second annular groove 411 abutting each protruding wedge portion 44 and the washer 412 held in the second annular groove 411 are, but not limited to, two sets. In the first embodiment each protruding wedge portion 44 includes at least one third annular groove 441, and the first fastening set 45 includes a plurality of first fasteners 451 run through two sides of the third annular groove 441 and fastened to the second fastening holes 245 of the positioning seat 244 so that the protruding wedge portion 44 can be fastened to the positioning seat 244. In this embodiment the third annular groove 441 on each protruding wedge portion 44 is, but not limited to, one set, and the first fasteners 451 are, but not limited to, two sets of screws. Furthermore, the LED lighting elements 3 are electrically connected with each other.

Figure 3A:
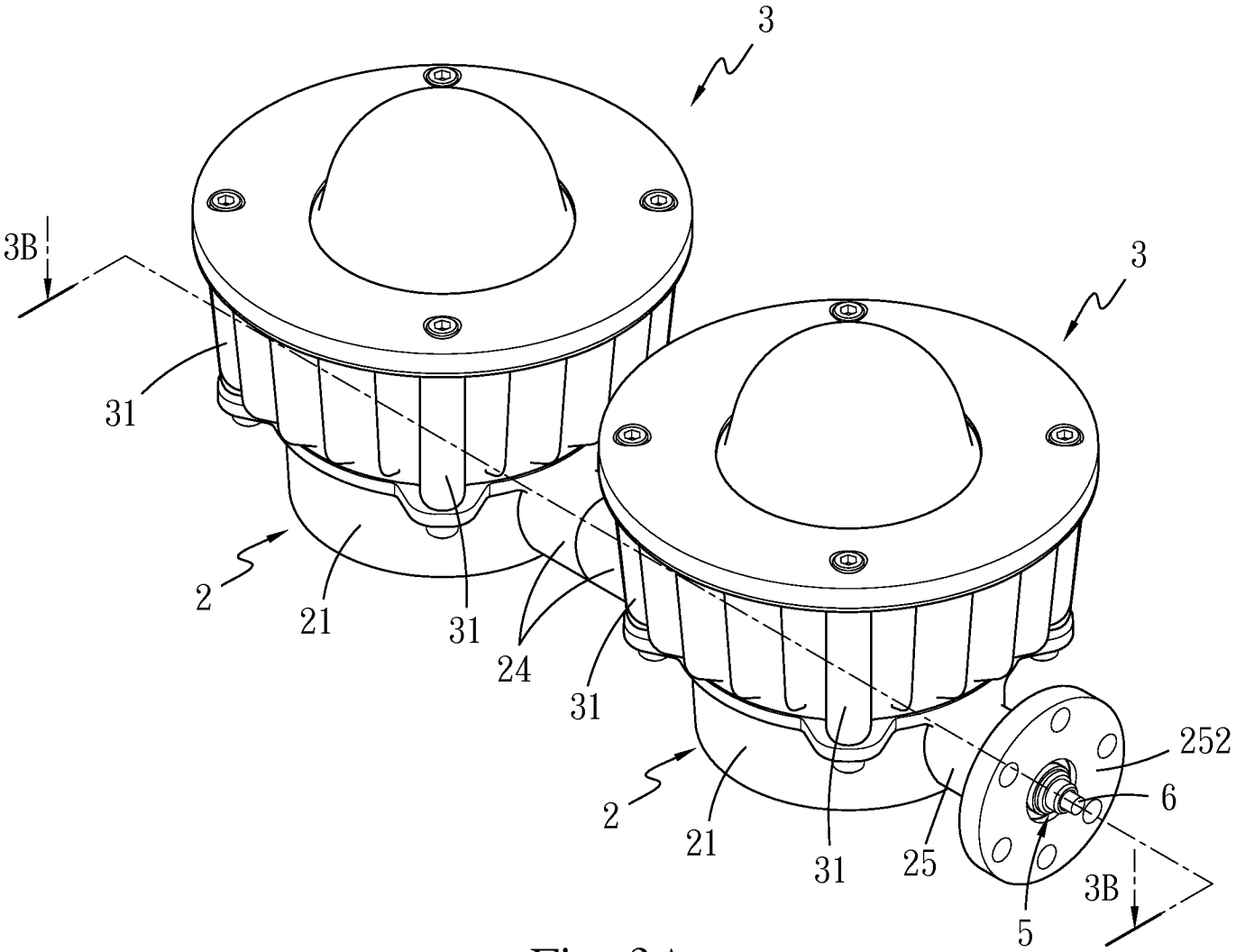
FIG. 3A is a perspective view according to FIG. 2 in an assembly condition.
Figure 3B:
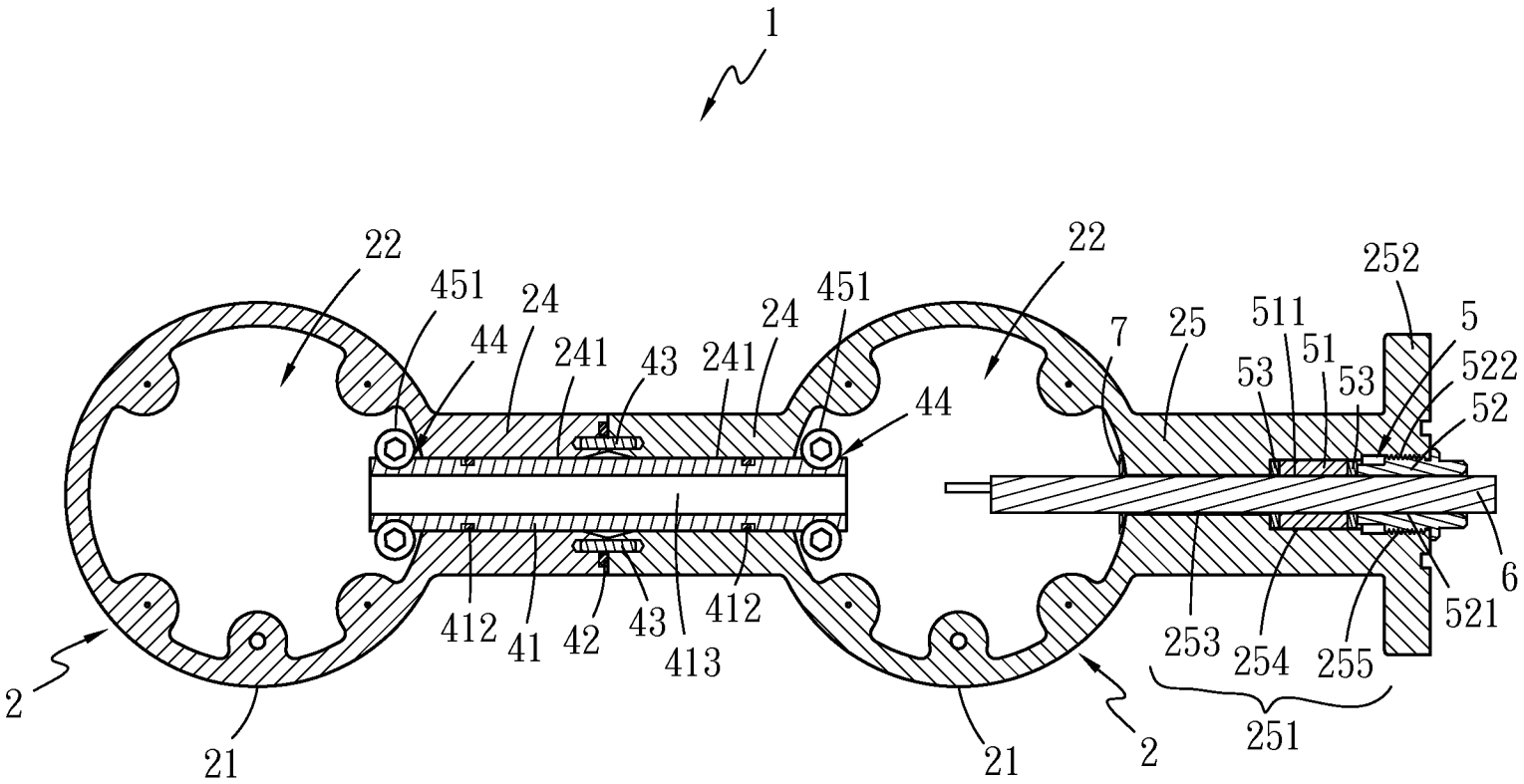
FIG. 3B is a sectional view taken on line 3B-3B in FIG. 3A.

Also referring to FIGS. 2 through 3B, the body 21 includes a second coupling portion 25 connected to one end thereof and communicating with the chamber 22 horizontally. The second coupling portion 25 and the first coupling portion 24 are positioned separately. The second coupling portion 25 has a threading space 251 communicating with the chamber 21 and holding a cable sealing means 5 and a cable 6, and a holding dock 252 remote from the body 21. The threading space 251 includes a first passage 253 abutting and communicating with the chamber 22 to allow the cable 6 to thread through, a second passage 254 communicating with the first passage 253 and remote from the chamber 22, and a thread section 255 communicating with the second passage 254 and remote from the first passage 253. The cable sealing means 5 includes an explosion-proof member 51, a compact plug 52 connected to the explosion-proof member 51 and screwed on the thread section 255, and two washers 53 located in the second passage 254 and pressed two ends of the explosion-proof member 51. In this embodiment, the washers 53 are, but not limited to, two sets. The explosion-proof member 51 includes an aperture 511 to hold the cable 6. In this embodiment the explosion-proof member 51 can be, but not limited to, an explosion-proof rubber ring. The compact plug 52 includes a through hole 521 threaded through by the cable 6 and a screwing portion 522 to couple and screw with the thread section 255. In this embodiment the compact plug 52 can be, but not limited to, a metal plug. The cable 6 is threaded through the through hole 521, the washers 53 and the aperture 511, and is anchored in the chamber 22 via an anchor plate 7. In this embodiment, the cable sealing means 5 is, but not limited to, held in the second coupling portion 25. Moreover, the body 21 equipped with the second coupling portion 25 can serve as a base for mounting onto a ceiling or a wall, and the holding dock 252 can be fastened to the ceiling or the wall through a plurality of fasteners. The quantity of the second coupling portion 25 and the holding dock 252 can be provided according to onsite requirements and be mounted onto the ceiling or the wall.

Figure 4:
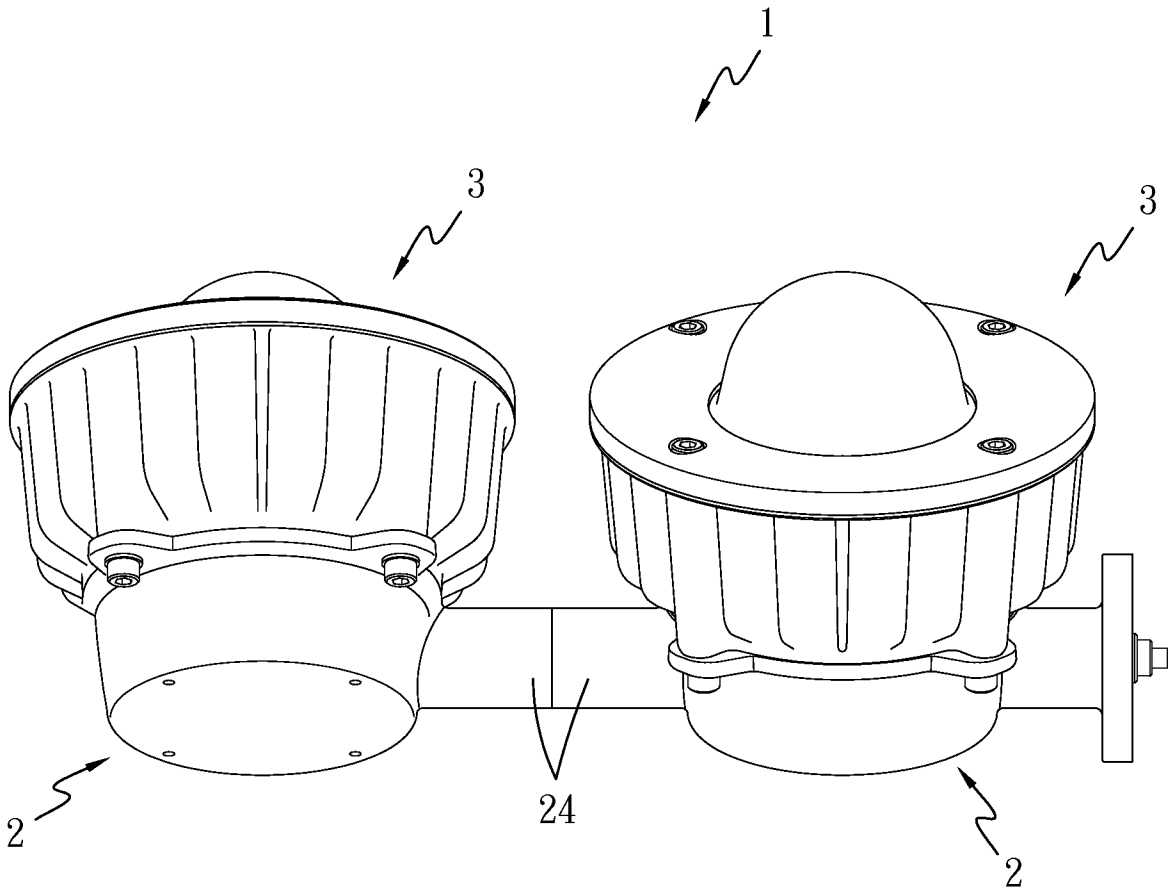
FIG. 4 is a perspective view of a second embodiment of the invention in an assembly condition.

Please refer to FIGS. 4 and 2 for a second embodiment of the invention. The pin holes 242 on each first coupling portion 24 can be provided in a plurality of pairs. Hence, one pair of the anchor members 43 can be selectively coupled with one pair of the fastening holes 242 to couple one holding set 2 with another holding set 2 at a different angle. In another embodiment one pair of pin holes 242 are provided on each first coupling portion 24, and two sets of body 21 are positioned at different angles, then by mating the pin holes 242 and the anchor members 43 as desired the two sets of body 21 can be coupled in different directions as shown in the LED explosion-proof lamp coupling structure 1 in FIG. 4.

Please refer to FIGS. 5, 6 and 2 for a third embodiment of the invention. As shown in FIG. 5, the second fastening hole 245 on each positioning seat 244 is one set, and each protruding wedge portion 44 includes at least one sunken hole 442 faced the second fastening hole 245. The first fastening set 45 includes at least one second fastener 452 run through the sunken hole 442 and fastened to the second fastening hole 245 so that the protruding wedge portion 44 can be anchored on the positioning seat 244. In this embodiment the sunken hole 422 and the second fastener 452 are respectively, but not limited to, one set. Also in this embodiment the second fastener 452 is, but not limited to, a screw. In a fourth embodiment shown in FIG. 6, two second fastening holes 245 are provided on the positioning seat 244, and each protruding wedge portion 44 includes at least one first recess 443, and the first fastening set 45 includes at least one anchor plate 453 located in the first recess 443 and a plurality of third fasteners 454 to fasten the anchor plate 453 to the positioning seat 244. The anchor plate 453 includes two lugs 455 bent outwards from two ends thereof and a fourth fastening hole 456 on each lug 455 to face each second fastening hole 245 of the positioning seat 244. Each fourth fastening hole 456 can be run through by one third fastener 454 to fasten to each second fastening hole 245 on the positioning seat 244 so that each protruding wedge portion 44 can be fastened to the positioning seat 244. In the first, third and fourth embodiments each protruding wedge portion 44 has the third annular groove 441, or the sunken hole 442 or the first recess 443 formed thereon, but this is not the limitation of the invention. The first fastening set 45 also can be the first fastener 451 or the second fastener 452, and/or the combination of the anchor plate 453 and the third fasteners 454 to fasten the protruding wedge portion 44 to the positioning seat 244, but this also is not the limitation of the invention.

Figure 7:
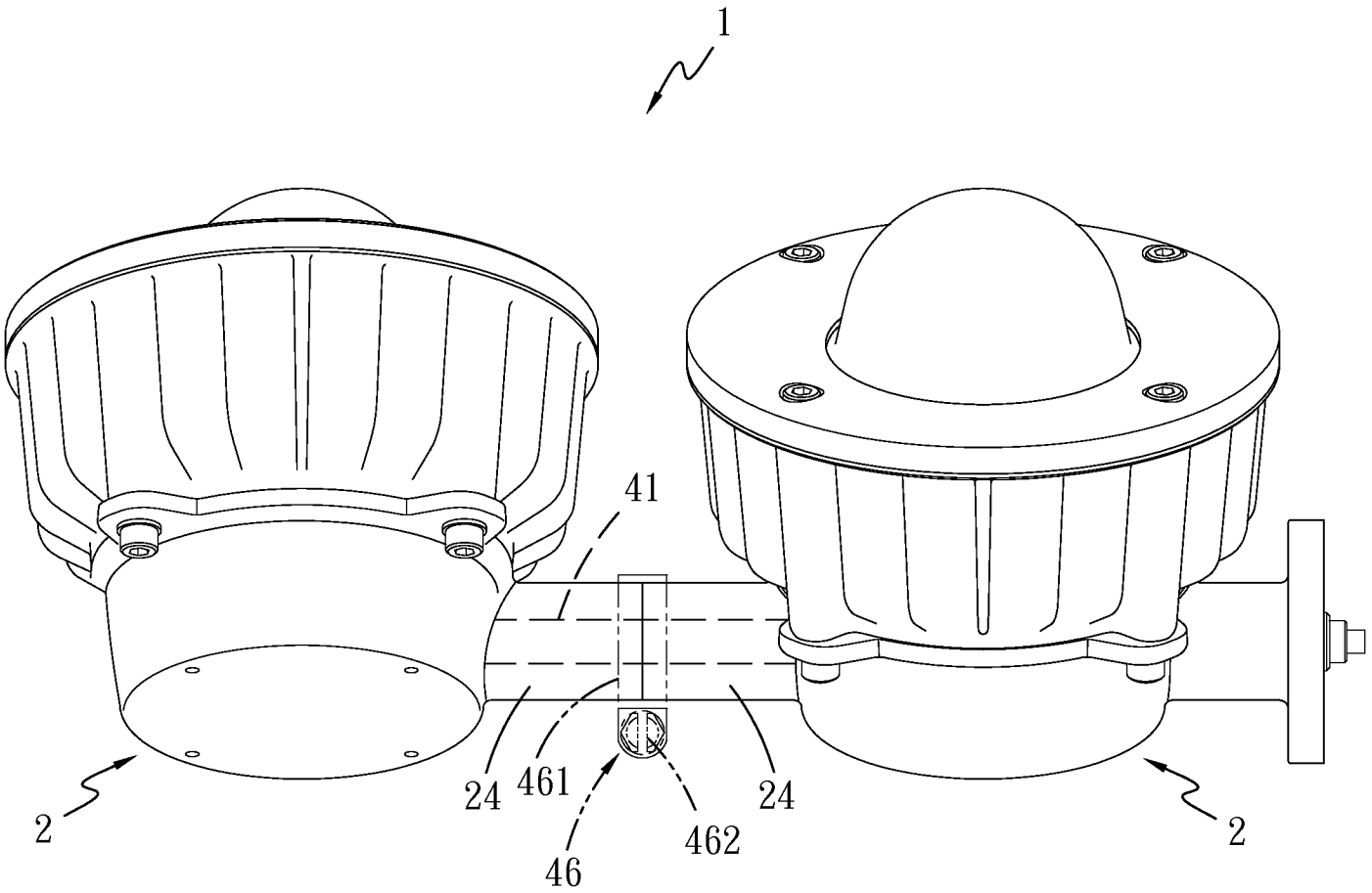
FIG. 7 is a perspective view of a fifth embodiment of the invention in an assembly condition.
Figure 8:
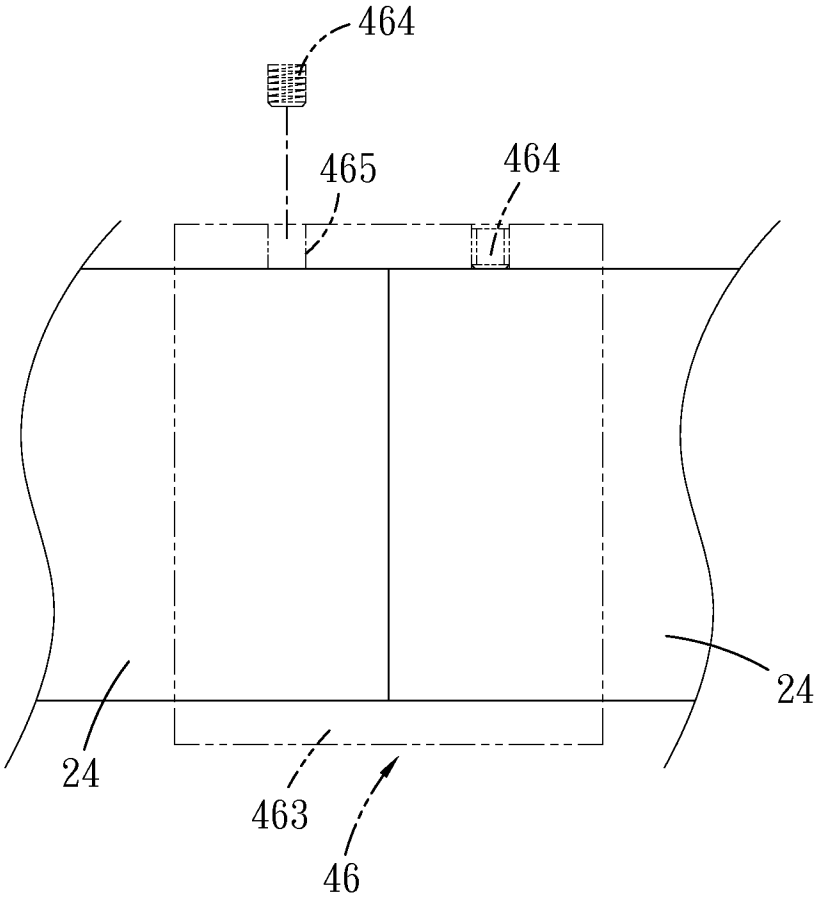
FIG. 8 is a fragmentary schematic view of a sixth embodiment of the invention in an assembly condition.
Figure 9:
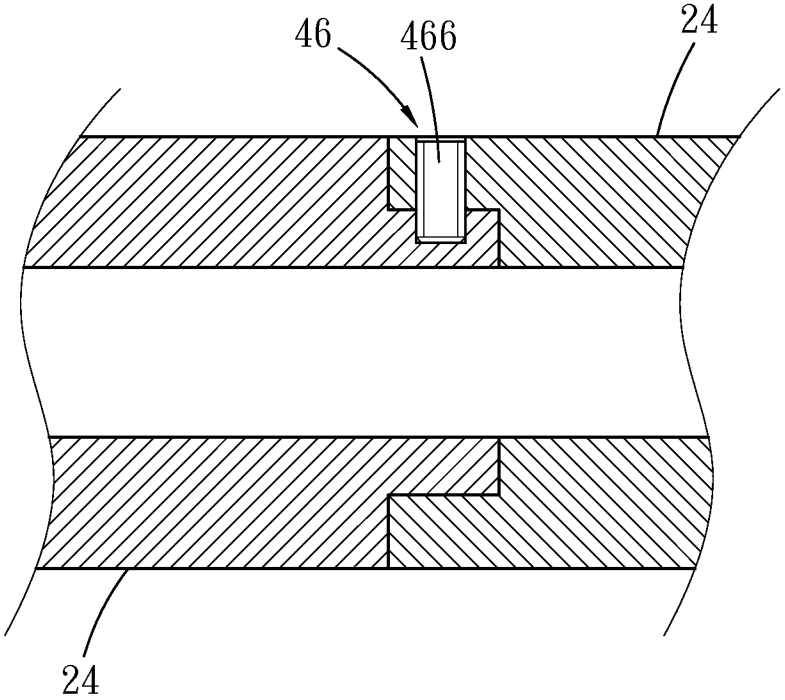
FIG. 9 is a fragmentary sectional view of a seventh embodiment of the invention.
Figure 10:
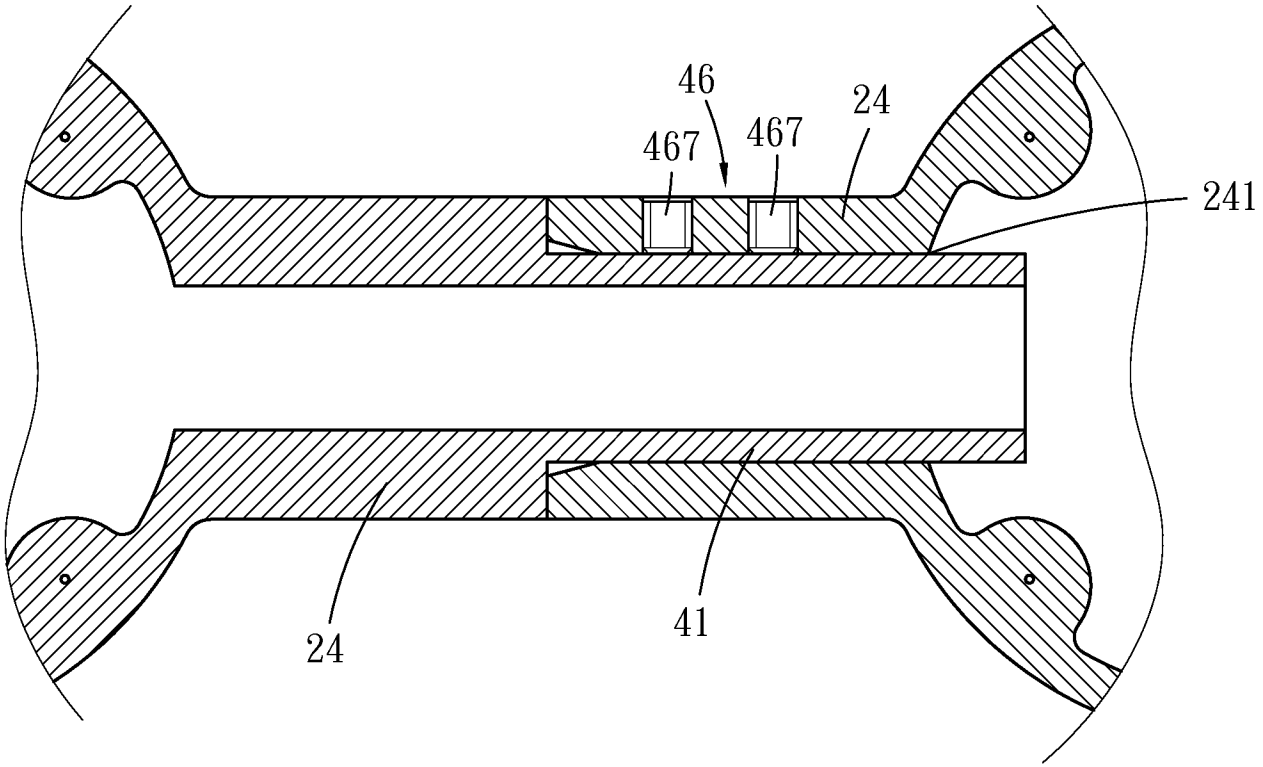
FIG. 10 is a fragmentary sectional view of an eighth embodiment of the invention.

Please refer to FIGS. 7 through 10 for fifth through eighth embodiments of the invention, also referring to the drawings and description of the first embodiment previously discussed. The connection unit 4 includes at least one second fastening set 46 connected to each first coupling portion 24 to couple the holding sets 2 with each other. In the fifth embodiment as shown in FIG. 7, the second fastening set 46 includes a tubular coupling member 461 connected to each first coupling port ion 24 and at least one fourth fastener 462 fastened to the tubular coupling member 461. In another alternative embodiment the connection tube 41 and the anchor members 43 can be replaced by the tubular coupling member 461 and the fourth fastener 462, so that one body 21 can be set at a same or different projection angle against another body 21, and the tubular coupling member 461 is fastened via the fourth fastener 462 to form implementation as shown in FIG. 2 or 3. In the sixth embodiment, referring to FIG. 8, the second fastening set 46 includes a coupling ring 463 connected to two first coupling portions 24 and at least one fifth fastener 464 fastened to the coupling ring 463. The coupling ring 463 includes at least one fifth fastening hole 465 located on the circumference thereof to be fastened by the fifth fastener 464 so that the coupling ring 463 can be fixedly connected to the first coupling portions 24. In another alternative embodiment the connection tube 41 and the anchor members 43 can be replaced by the coupling ring 463 and the fifth fastener 464 so that one body 21 can be set at a same or different projection angle against another body 21, and the coupling ring 463 is fastened via the fifth fastener 464 to form implementation as shown in FIG. 2 or 3. In this embodiment the fifth fastener 464 and the fifth fastening hole 465 include, but not limited to, two sets respectively. In the seventh embodiment as shown in FIG. 9, the first coupling portions 24 can be formed in a concave and convex coupling profile to couple the holding sets 2 together. One first coupling portion 24 has a concave shape in the middle, while another first coupling portion 24 has a convex shape in the middle corresponding to the concave shape, and the second fastening set 46 includes at least one sixth fastener 466 to fasten the first coupling portions 24 together so that the holding sets 2 also can be coupled together. In this embodiment the sixth fastener 466 is, but not limited to, one set. In another alternative embodiment the first coupling portions 24 can be formed in concave and convex profiles in an up and down manner to form interlock coupling between them and be fastened by a plurality of fasteners to couple the holding sets 2 together. In addition, in the eighth embodiment the connection tube 41 can be directly connected to the hole 241 of one first coupling portion 24 in an integrated manner as shown in FIG. 10. The connection tube 41 integrally coupled on one first coupling portion 24 can be coupled in the hole 241 of another first coupling portion 24 to fasten the holding sets 2 together. In this embodiment the second fastening set 46 includes at least one seventh fastener 467 which fastens one first coupling portion 24 integrally coupled with the connection tube 41 to another first coupling portion 24, but this is not the limitation of the invention. In another alternative embodiment the holding sets 2 can be coupled together with each other by the fastening approaches depicted in the first embodiment to the sixth embodiment, but all this is not the limitation of the invention.

As a conclusion, the invention, by coupling the connection tube with the hole in each first coupling portion and fastening the first coupling portion to each positioning seat can couple two holding sets together, thus improve appeal and resolve the unsightly exposure of the fastening elements that occur to the conventional techniques. Moreover, by mating the pin holes with the corresponding anchor members one holding set can be coupled with another holding set at different angles, thereby allow the LED explosion-proof lamp coupling structure to provide various projection angles with greater appeal in appearance.

What is claimed is:

1. An LED explosion-proof lamp coupling structure for coupling at least two LED explosion-proof lamps, comprising:

at least two holding sets each including a body, a protruding connection portion located on an upper end of the body, a chamber located in the body and the protruding connection portion, and at least one first coupling portion horizontally located at one end of the body and communicating with the chamber;

at least two LED lighting elements each being connected to the protruding connection portion of each holding set; and at least one connection unit including a connection tube which includes two ends to connect respectively the first coupling portion of each holding set to allow the holding sets to couple with each other.

2. The LED explosion-proof lamp coupling structure of claim 1, wherein the holding set further includes a second coupling portion disposed on the body and communicating with the chamber, the second coupling portion and the first coupling portion being positioned separately.

3. The LED explosion-proof lamp coupling structure of claim 2, wherein the second coupling portion includes a holding seat remote from the body.

4. The LED explosion-proof lamp coupling structure of claim 2, wherein the second coupling portion includes a threading space located therein and communicating with the chamber.

5. The LED explosion-proof lamp coupling structure of claim 4, wherein the threading space includes a first passage communicating with and abutting the chamber, a second passage communicating with the first passage and remote from the chamber, and a thread section communicating with the second passage and remote from the first passage.

6. The LED explosion-proof lamp coupling structure of claim 5 further including a cable sealing set which is located in the threading space and includes an explosion-proof member located in the second passage, a compact plug abutting the explosion-proof member and screwed on the thread section, and two washers located in the second passage to press two ends of the explosion-proof member.

7. The LED explosion-proof lamp coupling structure of claim 6, wherein the explosion-proof member is an explosion-proof rubber ring and the compact plug is a metal plug.

8. The LED explosion-proof lamp coupling structure of claim 1, wherein the first coupling portion includes a hole communicating with the chamber and run through by the connection tube, and a positioning seat located on the chamber and abutting the hole to connect to the connection tube.

9. The LED explosion-proof lamp coupling structure of claim 8, wherein the first coupling portion further includes at least one pair of pin holes abutting the hole and remote from the chamber, and a first annular groove abutting the pin holes and remote from the hole.

10. The LED explosion-proof lamp coupling structure of claim 1, wherein the connection unit further includes at least one first fastening set to fasten the connection tube to each first coupling portion.

11. The LED explosion-proof lamp coupling structure of claim 8, wherein the connection unit further includes at least one first fastening set to fasten the connection tube to each positioning seat.

12. The LED explosion-proof lamp coupling structure of claim 9, wherein the connection unit further includes at least one first fastening set to fasten the connection tube to each positioning seat, a sealing ring located on each first annular groove and at least one pair of anchor members inserted in the pin holes.

13. The LED explosion-proof lamp coupling structure of claim 1, wherein the connection tube includes two protruding wedge portions located at two ends thereof, at least one second annular groove abutting the protruding wedge portion and a passage located therein.

14. The LED explosion-proof lamp coupling structure of claim 13, wherein the connection unit further includes at least one first fastening set connected to each protruding wedge portion.

15. The LED explosion-proof lamp coupling structure of claim 14, wherein each protruding wedge portion includes at least one third annular groove, the first fastening set including a plurality of first fasteners inserted in the third annular groove.

16. The LED explosion-proof lamp coupling structure of claim 14, wherein each protruding wedge portion includes at least one sunken hole, the first fastening set including at least one second fastener run through the sunken hole.

17. The LED explosion-proof lamp coupling structure of claim 14, wherein each protruding wedge portion includes at least one first recess, the first fastening set including at least one anchor plate located in the first recess and at least one third fastener connected to the anchor plate.

18. The LED explosion-proof lamp coupling structure of claim 1, wherein the connection unit includes at least one second fastening set connected to each first coupling portion.

19. The LED explosion-proof lamp coupling structure of claim 18, wherein the second fastening set includes a tubular coupling member connected to each first coupling portion and at least one fourth fastener fastened to the tubular coupling member.

20. The LED explosion-proof lamp coupling structure of claim 18, wherein the second fastening set includes a coupling ring connected to each first coupling portion and at least one fifth fastener fastened to the coupling ring.

* * * * *